US006339945B2

(12) United States Patent
Miller et al.

(10) Patent No.: US 6,339,945 B2
(45) Date of Patent: Jan. 22, 2002

(54) APPARATUS FOR FORMING TAPERED SPIRAL TUBES

(75) Inventors: Robert E. Miller; James A. Marquis, both of Lafayette; Paul K. Davis, Auburn, all of CA (US)

(73) Assignee: Pacific Roller Die Co., Inc., Hayward, CA (US)

( * ) Notice: Subject to any disclaimer, the term of this patent is extended or adjusted under 35 U.S.C. 154(b) by 0 days.

(21) Appl. No.: 09/848,837

(22) Filed: May 3, 2001

Related U.S. Application Data

(63) Continuation of application No. 09/013,171, filed on Jan. 27, 1998.

(51) Int. Cl.[7] ..... B21C 37/12
(52) U.S. Cl. ..... 72/49; 72/50; 72/368
(58) Field of Search ..... 72/49, 50, 135, 72/137, 181, 367.1, 368

(56) References Cited

U.S. PATENT DOCUMENTS 3,210,980 A 10/1965 Sengel
3,650,015 A 3/1972 Davis
3,726,463 A 4/1973 Hoffmann et al.
3,775,835 A 12/1973 Cauffiel
3,940,962 A 3/1976 Davis
4,438,643 A * 3/1984 Menzel et al. ..... 72/49
5,079,938 A * 1/1992 Schwarz ..... 72/49
5,619,880 A 4/1997 Polster et al.
6,145,732 A * 11/2000 Akins et al. ..... 72/49

* cited by examiner

*Primary Examiner*—Ed Tolan
(74) *Attorney, Agent, or Firm*—Philip A. Dalton

(57) ABSTRACT

Apparatus for forming tapered spiral tubes from strips, is disclosed. The apparatus comprises a spiral tube forming system for forming a strip into a spiral tube; a strip infeed system adapted for feeding a strip to the pipe forming system; and computer-controlled means for continuously varying the angular orientation of the tube forming system relative to the strip infeed system to selectively vary the diameter of the forming tube. The selective variation of the diameter includes linearly tapered and curved profiles, as well as constant (unchanging) diameter profiles and combinations thereof.

7 Claims, 5 Drawing Sheets

APPARATUS FOR FORMING TAPERED SPIRAL TUBES

This is a continuation of allowed, pending application Ser. No. 09/013,171; filed Jan. 27, 1998; in the name of the inventors Robert F. Miller, James A. Marquis, Paul K. Davis; titled APPARATUS FOR FORMING TAPERED SPIRAL TUBES.

BACKGROUND OF THE INVENTION

1. Field of the Invention

The present invention relates generally to spiral tubes and pipes formed by spiralled, joined strips.

2. Definitions and Applicability

The present invention is applicable to spiral tubular products generally, including both tubes and pipes. Frequently here for brevity, we use one word or the other, but it is understood the invention is applicable to both. Also, although the exemplary system forms smooth wall tubular products, it will be readily apparent to those familiar with the technology that the. invention is applicable, in addition to smooth wall tubular products, to profiled (including sinusoidal or corrugated) tubular products.

3. Current State of the Relevant Field

Typically, spiral tubes and pipes are formed to a constant diameter. The relevant factors, (1) strip width, (2) angle of strip entry into the rolls, and (3) the position of the pressure roll relative to the other rolls, are held constant to maintain the desired diameter. Several approaches are available in the technology to prevent diameter deviations and thus maintain diameter control in such a system. For example, commonly assigned U.S. Pat. Nos. 3,650,015 and 3,940,962 describe equipment and methods for forming spiral tubular products. The '015 patent describes a unique free-forming approach for forming parallel wall corrugated tubes. The '962 patent discloses methods and apparatus for controlling the diameter of spiral tubing made with a three-roll mill by displacing the joined edges of the helical convolutions radially relative to the longitudinal axis of the tubing to correct for diameter deviations. The '015 and '962 patent are incorporated by reference.

SUMMARY OF THE INVENTION

In one aspect, the present invention is embodied in apparatus for forming tapered spiral tubes from strips, which comprises a tube forming system which forms a strip of material such as metal into a spiral tube; and a strip infeed system which is adapted for feeding a strip to the spiral tube forming system. The tube forming system and the strip infeed system are adapted for pivotal movement relative to one another to vary the helix angle between these components and thus vary the diameter of the resulting spiral tube. The apparatus further includes a drive system for effecting the desired pivotal movement between the strip infeed system and the tube forming system; and a computer system which is operatively connected to the motor drive system for operating the motor drive system to vary the helix angle as required.

In another embodiment, the strip infeed system itself is adapted for pivotal movement relative to the tube forming system to vary the helix angle. In yet another embodiment, the strip infeed system is mounted on wheels for pivotal movement relative to the tube forming system to effect the desired variation of the helix angle. In a preferred embodiment, the tube forming system is a three roll system comprising cooperating lead roll, buttress roll and mandrel sets.

Other aspects and embodiments of the present invention are described in the specification, drawings and claims.

BRIEF DESCRIPTION OF THE DRAWINGS

The above and other aspects of the invention are described below in conjunction with the following drawings.

DETAILED DESCRIPTION OF THE PREFERRED EMBODIMENT(S)

Figure 1:
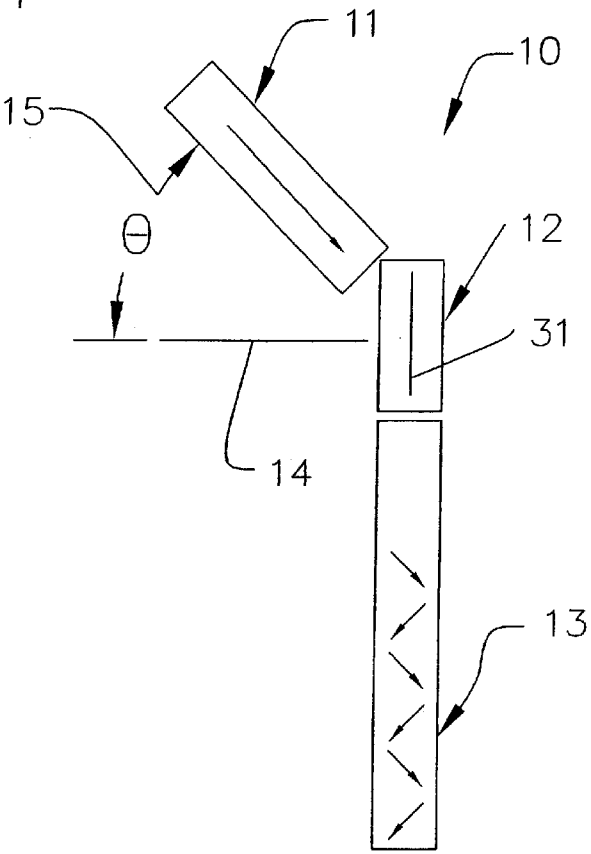
FIG. 1 is a simplified, schematic representation of one embodiment of a taper tube spiral mill apparatus or system in accordance with the present invention.

FIG. 1 is a simplified, schematic representation of one embodiment 10 of a taper tube spiral mill system or apparatus in accordance with the present invention. The mill apparatus 10 comprises (1) an infeed section or system 11 for continuously unwinding a strip 16, FIG. 3, of material such metal, typically carbon steel; (2) an exemplary three roll spiral tube-forming machine system 12, for forming the strip into a spiral tube of controlled, preferably constant slope, varying diameter; and (3) a discharge section or system 13. The strip infeed section 11 feeds the strip 16 (hereafter steel strip) into the three roll spiral tube-forming machine system 12, where the strip is spirally wound into a tube such as the illustrated tube 17, FIG. 7. The illustrated apparatus 10 uses a smooth wall pipe mill. However, the apparatus is applicable to form the various types of spiral pipes or tubes, including smooth wall welded seam, smooth wall lockseamed, corrugated lockseamed and corrugated welded seam pipes or tubes.

The relationship between the width of a steel strip such as the exemplary strip 16 and the diameter, d, of the resulting tube such as 17 is given by the formula:

$$d = \frac{FSW}{\pi \sin\theta}$$

where: d=pipe diameter (see FIGS. 4 and 7),

FSW=finished strip width, and

Θ=the angle between the infeed section 11 and a line 14 perpendicular to the spiral pipe discharge table (the helix angle).

If the helix angle Θ and the finished strip width, FSW, of the strip 16 being fed into the machine stay constant, the pipe diameter will also remain constant. However, if the helix angle Θ is varied while the finished strip width remains constant, the diameter of the tube produced will vary according to the above formula. If Θ is varied while the mill is running, that is, while strip 16 is continuously fed into the mill and formed, a tapered tube of changing diameter will result. More specifically, if the helix angle Θ of the mill is increased as the mill is running, the diameter of the tube will decrease. Conversely, if the helix angle (Θ) is decreased, the diameter of the tube will increase.

Figure 2:
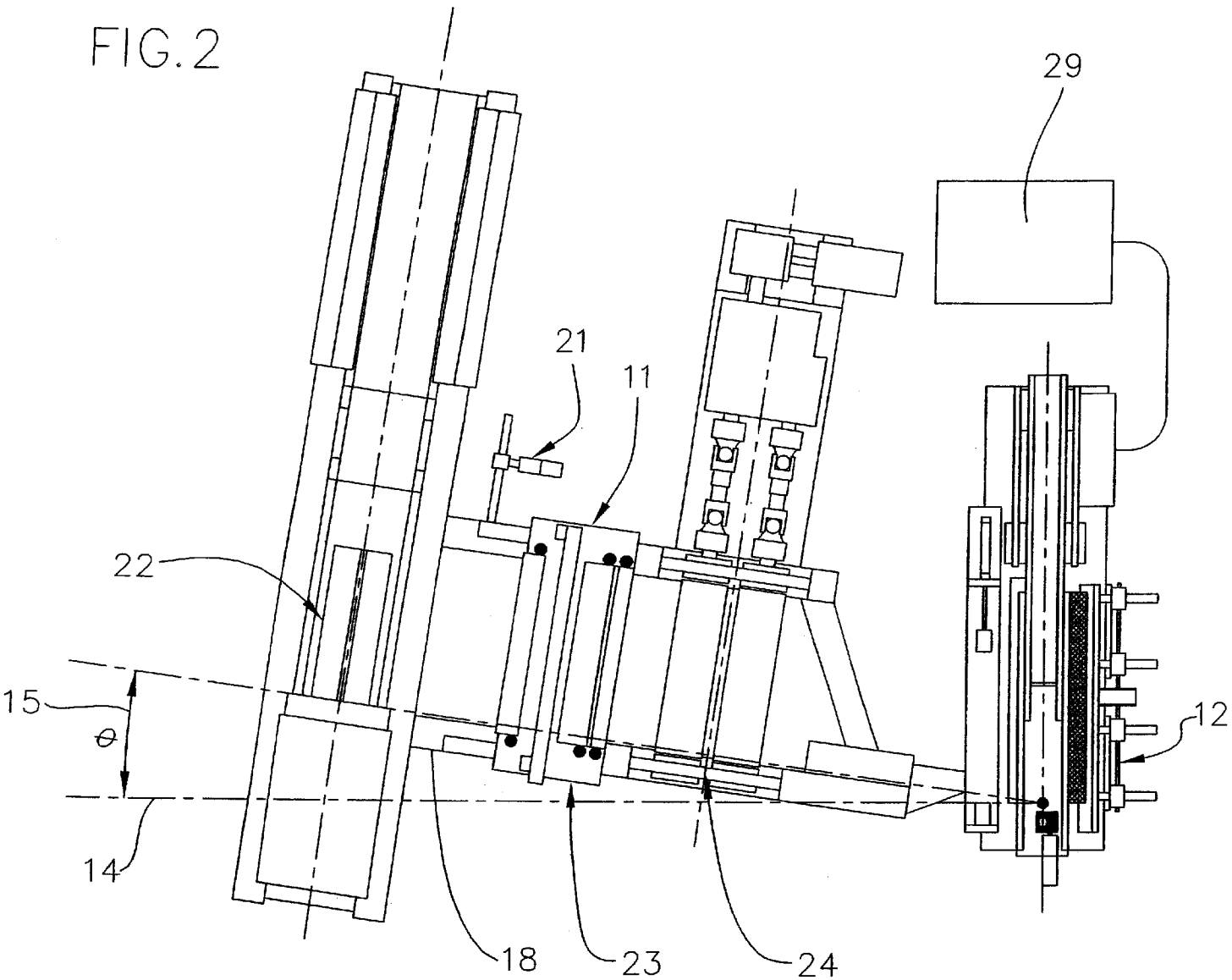
FIG. 2 is a simplified top plan view of a taper tube spiral mill system in accordance with the present invention.
Figure 3:
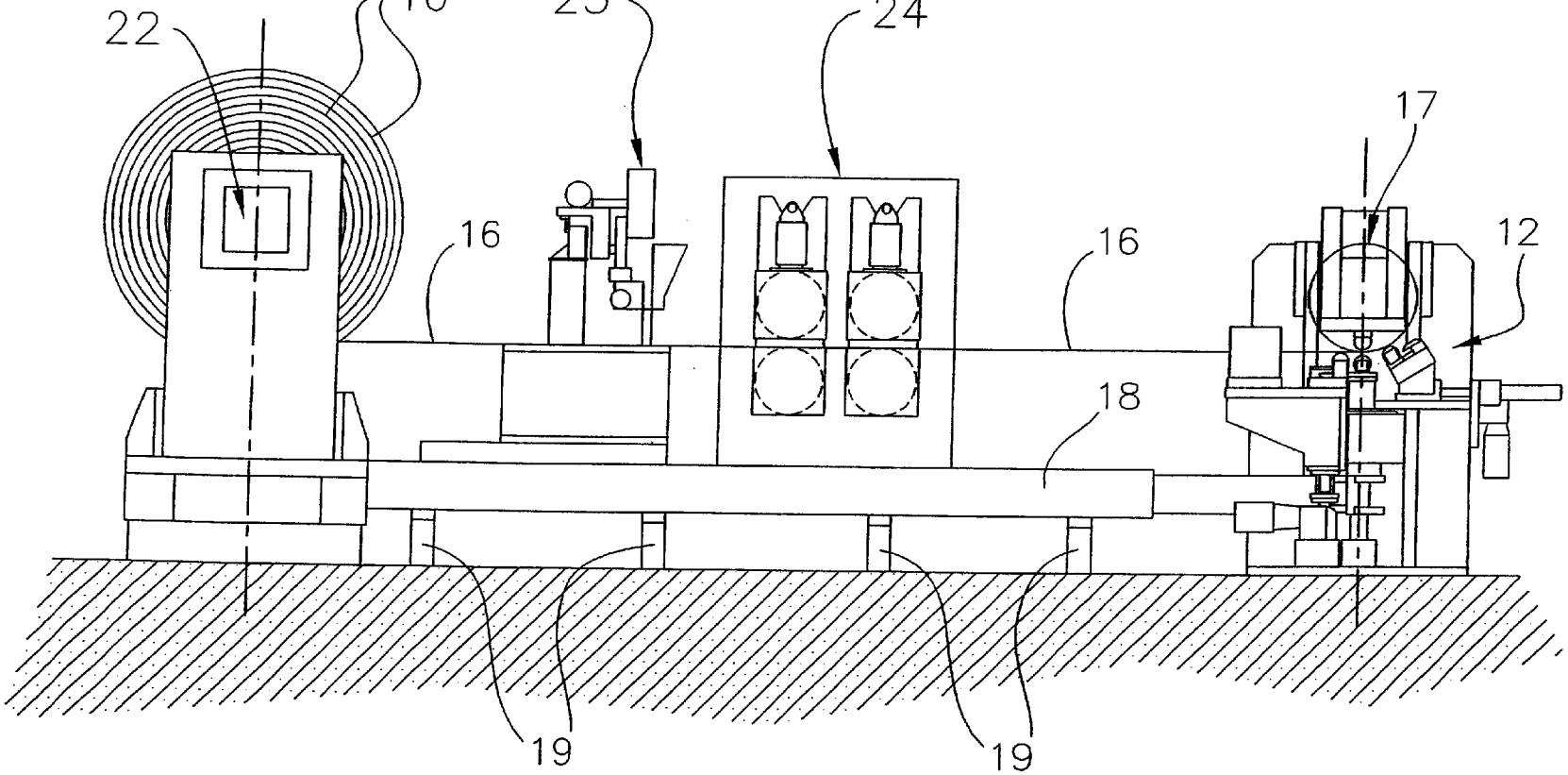
FIG. 3 is a side elevation view of the taper tube spiral mill system of FIG. 2.
Figure 4:
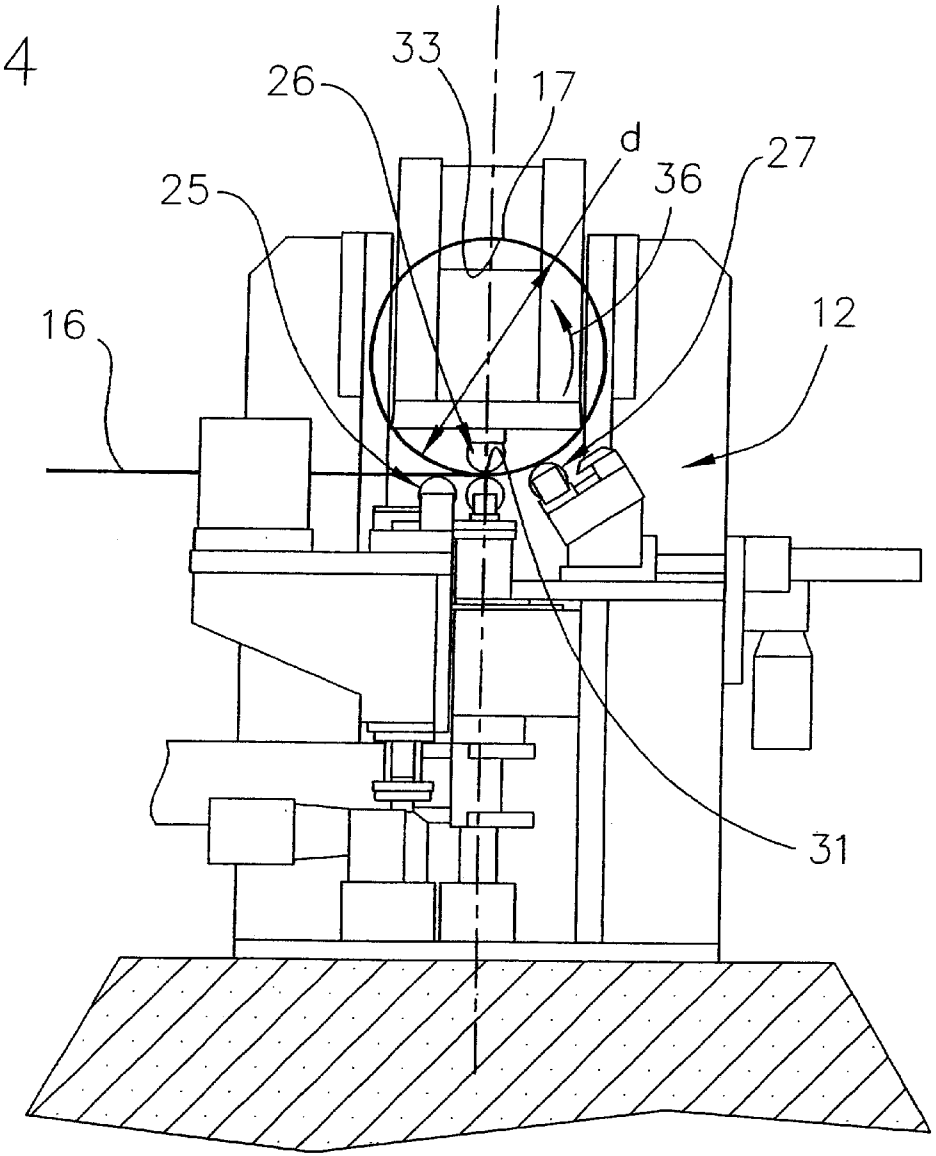
FIG. 4 is an end elevation view of the taper tube spiral mill system of FIG. 2.

Referring now to FIGS. 2–4, in one embodiment according to the present invention, the taper tube spiral mill system 10 comprises an elongated mill base 18 on which is mounted the components of the strip infeed system 11. Wheels 19—19, FIG. 3, are mounted on the bottom side of the mill base 18 and permit the base to be rolled along the shop floor. A motor-driven screw jack 21 is connected to the mill base for moving the base bidirectionally to pivot the infeed system 11 as indicated by arrow 15, FIGS. 1 and 2, and vary the helix angle Θ. The infeed system 11 includes a conventional uncoiler 22 which is mounted on the mill base 18. A coil of the steel strip 16 is wrapped around the uncoiler and plays out along the infeed section 11 to the spiral tube-forming machine 12. (Strip 16 is omitted in FIG. 2 to facilitate viewing the components of the system.) The strip exiting the uncoiler 22 is fed to a conventional coil end joiner 23, which squares the trailing and leading ends of consecutive strips and welds the ends to form the continuous strip 16. From there the strip 16 is driven through the main mill drive system 24, which comprises a plurality of stands or pairs of rolls, each having an upper roll and a lower roll. The pairs of rolls receive the strip 16 and drive it into the spiral machine system 12. Preferably, the spiral machine system 12 comprises three sets of rolls, a lead roll set 25, FIG. 4, a mandrel set 26, and a buttress roll set 27. As discussed below, preferably the lead roll set and the buttress roll set are articulated. The three roll apparatus bends the strip 16 into spiral tube 17, In the illustrated up curve system 10, the inner roll of the inner and outer rolls (upper and lower rolls) which comprise the mandrel roll set 26 serves as a fulcrum. As the strip 16 is driver forward by the drive roll system 24, the opposing lead roll set and buttress roll set curl the continuously advancing strip 16 around the mandrel set 26, upwardly in the direction of arrow 36, in an arc which describes the selected diameter relative to the center axis 35 of the tube.

The desired pipe diameter, d, and specifically, the desired varied diameter profile is effected by a computer or programmable logic controller system 29, FIG. 2, which is connected to an electrical motor that drives the screw jack mechanism. The computer is programmed to control the winding and unwinding of the screw jack and thus bidirectionally move the infeed section 11 and alter (increase and decrease) the helix angle Θ as required as the strip 16 is fed to the spiral machine 12. Thus, the computer-controlled drive system can continuously control (increase, decrease and/or maintain constant) the helix angle Θ.

Figure 5:
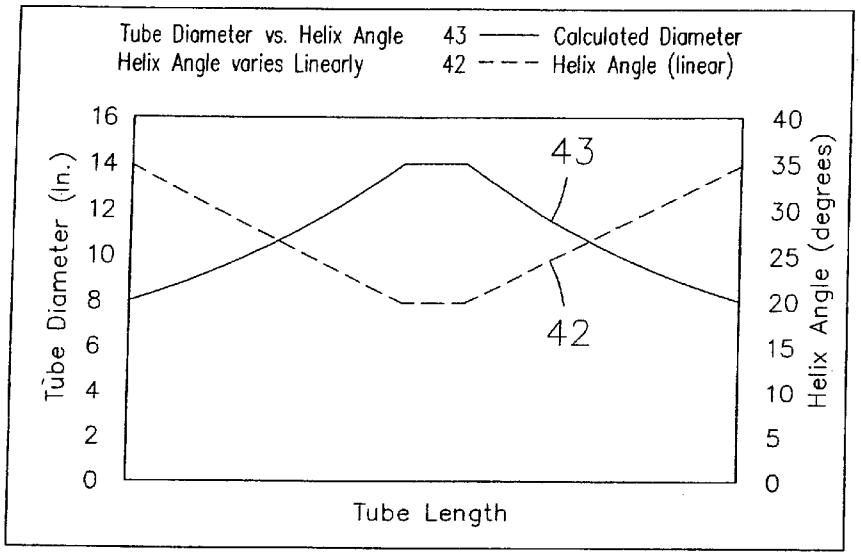
FIG. 5 is a chart showing the variation of tube diameter as a function of the helix angle Θ as Θ is varied linearly.
Figure 6:
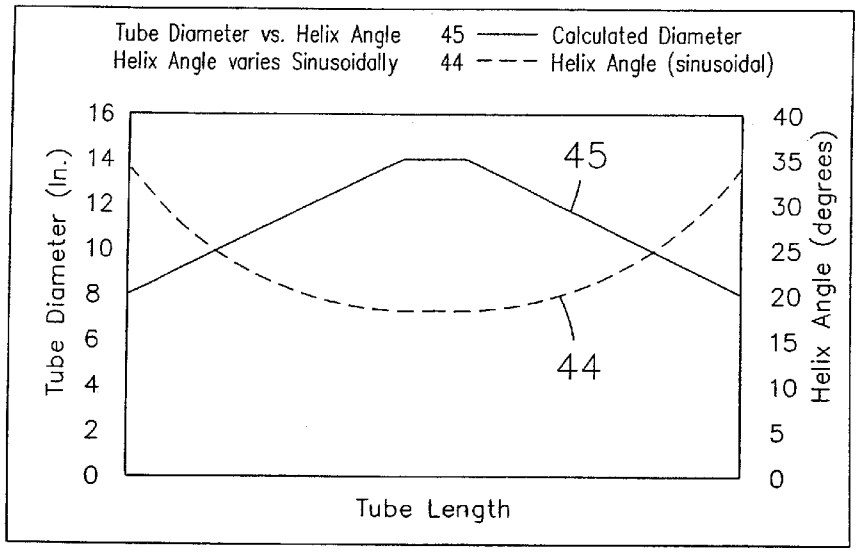
FIG. 6 is a chart showing the variation of tube diameter as a function of the helix angle Θ as Θ is varied sinusoidally.

As indicated in the above formula, the diameter of the tube is inversely proportional to the sine of the helix angle Θ. Referring to FIG. 5, when the helix angle Θ is varied linearly, as indicated by curve 42, the sides of the tube are not straight or linear; rather they have a sinusoidal curvature and the tube diameter varies sinusoidally, as indicated by curve 43. FIG. 6 illustrates that by varying the helix angle Θ according to a sinusoidal profile, curve 44, during the tube formation process, the tube can have straight sides and the diameter varies linearly, curve 45. Thus, to obtain a linearly varying, or curved, or constant diameter profile, the computer 29 is programmed to drive the screw jack so that the helix angle Θ varies sinusoidally, or linearly, or is maintained constant. In addition, the computer system 29 can control the helix angle Θ to provide combinations of these profiles along a given tube, that is to provide different profiles, including positive and negative linear and curved slopes, along different sections of a tube. In short, preferably the tube walls are linearly tapered, forming concentric circles of increasing or decreasing diameter centered about and perpendicular to axis 35, see FIG. 7. However, the illustrated apparatus can be used to form constant radius parallel wall tubular products, or irregularly tapered tubular products, or curved wall products, or combination products in which different sections have different wall profiles selected from parallel and/or linearly tapered and/or curved and/or irregularly tapered.

Illustratively, at least two methods can be used to vary the mill helix angle (Θ). First, and preferably, as described above, the helix angle (Θ) of the mill can be varied using the electrically driven screw jack mechanism 21, which is driven by a motor whose output speed is controlled by the programmable motor controller. The programmable motor controller can be programmed to vary the motor speed continuously according to any required profile. Alternatively, the helix angle (Θ) of the mill can be varied using a rack and pinion drive (or a traction wheel drive) whose driving speed is varied using by the programmable motor controller. The driving unit will be mounted to the infeed section mill base with the rack mounted to the floor.

The prior art approach described previously uses apparatus which is referenced to the center line or axis of the constant diameter tube. In contrast, and referring to FIGS. 4 and 7, to facilitate manufacturing of varied diameter tubular products, the present invention preferably uses a common pass line 31, which is defined by the upper (inner) mandrel roll, FIG. 4, and corresponds approximately to the bottom center line 32 of the tube 17, FIG. 7. In a presently preferred arrangement, to maintain the required location and orientation as the diameter changes, the lead and buttress roll sets are articulated.

Instead of the illustrated up curve machine, a down curve machine may be preferred for forming large diameter spiral tubes. In the down curve arrangement, the three forming rolls and common pass line 33 are located at the top of the machine and the advancing strip 16 curls downward from the top center line 34 of the tube, FIG. 7, in the direction opposite to that of arrow 36.

Presently, the system 10 can be used for tubular products having diameters as small as about 5 inches and to form tubular products which taper as much as approximately 0.25 inches per foot of tube length.

Various types of spiral edge joining and fastening approaches and materials can be used, including lockseam, submerged arc welding and high speed welding. Lockseam joining is similar to that used for spiral corrugated rib pipe product, but with the lockseam on inside of tube to provide a smooth exterior. It may be advantageous to use a precoating on steel strip materials to protect from corrosion. Precoating materials include zinc and/or aluminum and/or polymers and/or combinations thereof. The submerged arc welding is the same as for spiral constant diameter pipes. This involves welding inside and out. Uncoated, mild steel can be used. Finally, but not exhaustively, high speed weld uses high frequency contact resistance welding developing a mash lap type of weld wherein the two strip edges are heated to a plastic state and pressed one into the other from a top and bottom position. This system could utilize both precoated zinc strips and uncoated metals.

Figure 7:
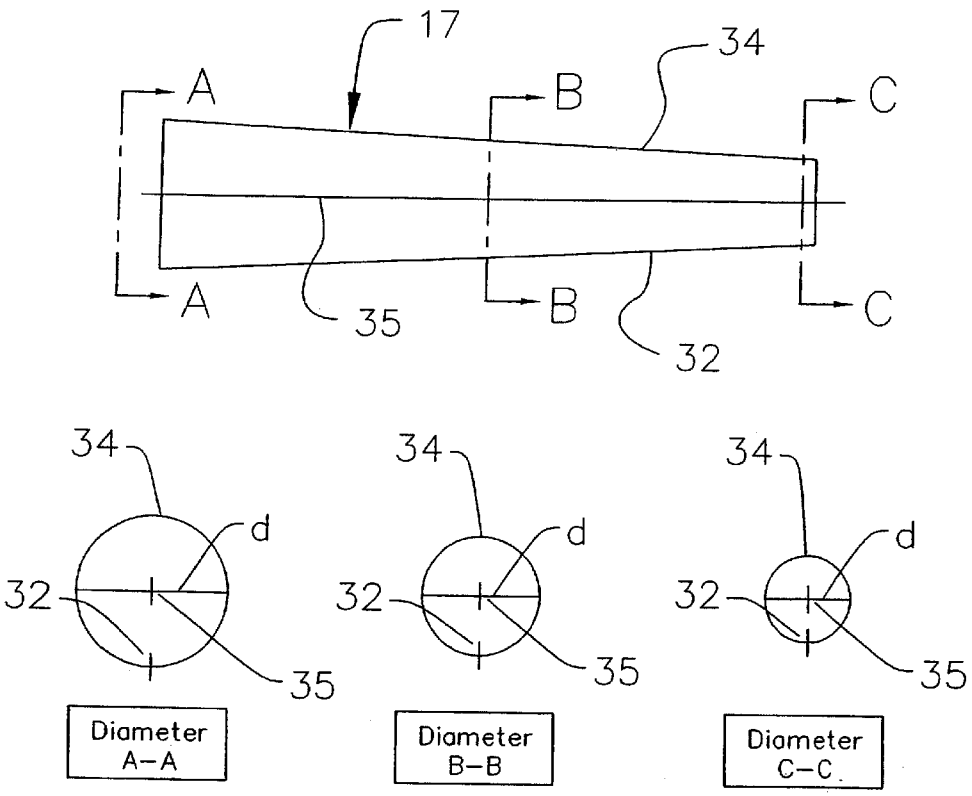
FIG. 7 depicts an example of a tapered spiral tube or pipe formed by the apparatus of FIGS. 1–4.

Please note, using the common pass line manufacturing approach, before separation into individual tubes, the profile of the continuously formed tube looks somewhat like a saw. One side of the tube structure is flat and the other side has tapered "saw teeth" corresponding to the different tapered tubes or tube sections included in the continuous tube structure. For the illustrated up curve machine and its bottom common pass line, the bottom of the continuous tube is flat and the top has the saw tooth appearance. Referring to FIG. 7 (which depicts one tapered section or tube), the tube axes 35 of the individual tapered tubes or tapered tube sections and the associated diameters of the tubes are oriented at complementary, non-perpendicular acute angles to the horizontal common pass line 31 (32). This orientation is taken into account during separation into the individual tubes. For example, to make each end cut of a tube perpendicular to the pipe axis 35, one approach is to use a double cut-off process with plasma torches or with a mechanical cut-off such as friction saws or rotary cutting tools.

Regardless of the method used to vary the helix angle (Θ) of the mill, the result will be a tapered tube such as 17, FIG. 7, the final shape of which is controlled by varying the helix angle (Θ) of the mill according to a schedule derived from the above formula.

The present invention has been described in terms of a preferred and other embodiments. The invention, however, is not limited to the embodiments described and depicted. One familiar with the art to which the present invention pertains will appreciate from the embodiments disclosed here, that the present invention is applicable in general to spiral tubular products, including corrugated, ribbed and smooth wall spiral tubular products. The invention is defined by the claims appended hereto.

What is claimed is:

1. Apparatus for forming tapered spiral tubes from metal strips, comprising: a spiral tube forming system for forming a metal strip of approximately constant width into a spiral tube; a strip infeed system for feeding said metal strip to the tube forming system; the tube forming system and the strip infeed system defining an angle Θ therebetween; the strip infeed system being mounted for pivotal movement relative to the tube forming system to vary the angle Θ; a motor drive system operatively connected to the strip infeed system for effecting said pivotal movement; and a computer system operatively connected to the motor drive system for operating the motor drive system to selectively vary angle Θ and thereby selectively vary the diameter of a spiral tube being formed by the tube forming system.

2. Apparatus for forming tapered spiral tubes from metal strips, comprising: a tube forming system for forming a metal strip into a spiral tube, the tube forming system comprising cooperating articulated lead roll, articulated buttress roll and mandrel roll; the lead roll, buttress roll and mandrel roll being free-rotating; a strip infeed system for feeding a metal strip of substantially constant width to the lead roll of the tube forming system; the strip infeed system and the tube forming system being oriented at an angle Θ therebetween; the strip infeed system being mounted on wheels for pivotal movement relative to the tube forming system to vary the angle Θ; a motor drive system operatively connected to the strip infeed system for effecting said pivotal movement; and a computer system operatively connected to the motor drive system for operating the motor drive system to selectively vary the angle Θ sinusoidally to linearly vary the diameter of a spiral tube being formed from the metal strip by the tube forming system.

3. Apparatus for forming tapered spiral tubes from metal strips, comprising: an elongated tube forming system for forming an elongated metal strip of approximately constant width into a spiral tube, the tube forming system comprising cooperating lead roll, buttress roll and mandrel roll sets; a strip infeed system for feeding said metal strip to the lead roll set of the tube forming system; the strip infeed system and the tube forming system being oriented at an angle Θ therebetween; the strip infeed system being mounted for pivotal movement relative to the tube forming system to vary the angle Θ; a motor drive system operatively connected to the strip infeed system for effecting said pivotal movement; and a computer system operatively connected to the motor drive system for operating the motor drive system to selectively vary the angle Θ sinusoidally thereby to linearly vary the diameter of a spiral tube being formed by the tube forming system.

4. The apparatus of claim 3, wherein the lead and buttress roll sets are articulated.

5. Apparatus for forming tapered spiral tubes from metal strips, comprising: an elongated tube forming system for forming a metal strip of approximately constant diameter into a spiral tube, the tube forming system comprising cooperating lead roll, buttress roll and mandrel roll set; the lead roll, buttress roll and mandrel roll being free-rotating; a strip infeed system for feeding said metal strip to the lead roll of the tube forming system; the strip infeed system and the tube forming system being oriented at an angle Θ therebetween; means mounting the strip infeed system for pivotal movement relative to the tube forming system to vary the angle Θ; a motor drive system operatively connected to the strip infeed system for effecting said pivotal movement; and a computer system operatively connected to the motor drive system for operating the motor drive system to selectively vary the angle a sinusoidally to linearly vary the diameter of a spiral tube being formed from said metal strip by the tube forming system.

6. The apparatus of claim 5, wherein the lead and buttress roll sets are articulated.

7. A method for forming a tapered spiral tube, comprising: forming a spiral tube by feeding an elongated thin strip of constant width into a spiral tube forming system using an angle Θ between the tube forming system and the strip; and while feeding the strip, varying the angle Θ sinusoidally thereby to linearly vary the diameter of the spiral tube as it is being formed.

* * * * *

UNITED STATES PATENT AND TRADEMARK OFFICE

CERTIFICATE OF CORRECTION

PATENT NO. : 6,339,945 B2 
DATED : January 22, 2002
INVENTOR(S) : Miller, Robert F, James A. Marquis and Paul K. Davis It is certified that error appears in the above-identified patent and that said Letters Patent is hereby corrected as shown below:

Title page,
Item [75], Inventors, change "Robert E. Miller" to -- Robert F. Miller --.

Column 6,
Line 41, change "angle a" to -- angle θ --.

Signed and Sealed this

Twentieth Day of August, 2002

*Attest:*

*Attesting Officer*

JAMES E. ROGAN
*Director of the United States Patent and Trademark Office*